US007188490B2

(12) United States Patent
Jeong et al.

(10) Patent No.: US 7,188,490 B2
(45) Date of Patent: Mar. 13, 2007

(54) REFRIGERATOR

(75) Inventors: Gi Joong Jeong, Kwangju (KR); Jong Dal Lee, Suwon (KR); Myung Wouk Kim, Kwangju (KR); Jae-Seung Lee, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 266 days.

(21) Appl. No.: 10/687,673

(22) Filed: Oct. 20, 2003

(65) Prior Publication Data

US 2004/0139763 A1 Jul. 22, 2004

(30) Foreign Application Priority Data

Jan. 17, 2003 (KR) ..... 10-2003-0003373
Mar. 28, 2003 (KR) ..... 10-2003-0019482

(51) Int. Cl.
*F25D 19/02* (2006.01)
*F25D 17/04* (2006.01)

(52) U.S. Cl. ..... 62/448; 62/407; 62/298

(58) Field of Classification Search ..... 62/448, 62/407, 440, 450, 515, 298; 312/116, 117
See application file for complete search history.

(56) References Cited

U.S. PATENT DOCUMENTS 1,543,349 A 6/1925 Walker
1,685,248 A 9/1928 Strufe
1,761,040 A * 6/1930 Hull ..... 62/407
1,780,425 A * 11/1930 Hull ..... 62/349
2,450,844 A 10/1948 Stuart
2,812,642 A 11/1957 Jacobs
2,815,649 A 12/1957 Di Angelus et al.
3,122,899 A 3/1964 Costantini et al.
3,126,716 A 3/1964 Witte
3,178,902 A 4/1965 Costantini et al.
3,353,314 A 11/1967 Melcher
3,405,987 A 10/1968 Pulaski (Continued)

FOREIGN PATENT DOCUMENTS

CA 633899 1/1962

(Continued)

OTHER PUBLICATIONS

Patent Abstracts of Japan, Japanese Application Publication No. 2000-65459, Publication Date Mar. 3, 2000. Abstract Only.

(Continued)

*Primary Examiner*—Chen Wen Jiang
(74) *Attorney, Agent, or Firm*—Staas & Halsey LLP

(57) ABSTRACT

A refrigerator including a body provided therein with a storage chamber, an uplifted part projected from a rear portion of a top of the body so that a cooling room is formed to have a space extending above the storage chamber, a machine room provided above a front portion of the top of the body and in front of the uplifted part, a cooling unit removably disposed in the cooling room, an evaporator and a cold air circulating fan provided in a cold air passage of the cooling unit, and circulating passages formed in upper and rear portions of the storage chamber, respectively, to be connected to the cold air passage of the cooling unit.

21 Claims, 12 Drawing Sheets

U.S. PATENT DOCUMENTS

| | | | | |
|---|---|---|---|---|
| 3,489,477 | A | | 1/1970 | Harder, Jr. |
| 3,590,594 | A | | 7/1971 | Arend |
| 3,620,404 | A | | 11/1971 | Grasso |
| 3,712,078 | A | | 1/1973 | Maynard et al. |
| 3,745,786 | A | | 7/1973 | Laughlin et al. |
| 3,834,176 | A | | 9/1974 | Clarke |
| 3,835,660 | A | | 9/1974 | Franck |
| 3,893,307 | A | | 7/1975 | Jacobs |
| 3,984,223 | A | | 10/1976 | Whistler, Jr. |
| 3,992,171 | A | | 11/1976 | Jenewein |
| 4,076,350 | A | | 2/1978 | Crist |
| 4,638,644 | A | | 1/1987 | Gidseg |
| 4,714,304 | A | | 12/1987 | Sisk et al. |
| 4,741,175 | A | | 5/1988 | Schulze |
| 4,776,182 | A | | 10/1988 | Gidseg |
| 4,822,117 | A | | 4/1989 | Boston, Jr. |
| 4,970,874 | A | | 11/1990 | Solak et al. |
| 5,086,627 | A | | 2/1992 | Borgen |
| 5,212,924 | A | | 5/1993 | Finkelstein |
| 5,284,023 | A | | 2/1994 | Silva et al. |
| 5,368,381 | A | | 11/1994 | Mandel |
| 5,531,267 | A | | 7/1996 | Ahmed et al. |
| 5,564,808 | A | | 10/1996 | Gipson et al. |
| 5,584,551 | A | | 12/1996 | Jenkins |
| 5,729,997 | A | | 3/1998 | Witsoe |
| 5,730,516 | A | | 3/1998 | Vismara |
| 5,826,442 | A | * | 10/1998 | Lee ..... 62/283 |
| 5,908,229 | A | | 6/1999 | Wetherholt et al. |
| 6,029,411 | A | | 2/2000 | Richardson |
| 6,036,294 | A | | 3/2000 | Banicevic et al. |
| 6,056,383 | A | | 5/2000 | Banicevic et al. |
| 6,070,424 | A | | 6/2000 | Bauman et al. |
| 6,094,934 | A | | 8/2000 | Rand et al. |
| 6,122,879 | A | | 9/2000 | Montes |
| 6,216,410 | B1 | | 4/2001 | Haberman |
| 6,341,830 | B1 | | 1/2002 | Chun |
| 6,381,981 | B1 | | 5/2002 | Yaddgo et al. |
| 6,464,312 | B1 | | 10/2002 | Tenhundfeld |
| 6,735,976 | B2 | | 5/2004 | Lee |
| 2002/0093276 | A1 | | 7/2002 | Kawakami |
| 2002/0117949 | A1 | | 8/2002 | Banicevic et al. |
| 2004/0040338 | A1 | | 3/2004 | Lee et al. |
| 2004/0041503 | A1 | | 3/2004 | Lee |
| 2004/0139763 | A1 | | 7/2004 | Jeong et al. |
| 2004/0144130 | A1 | | 7/2004 | Jung |
| 2004/0163408 | A1 | | 8/2004 | Kim et al. |

FOREIGN PATENT DOCUMENTS

| | | |
|---|---|---|
| CH | 435 339 | 5/1967 |
| DE | 1237148 | 3/1967 |
| EP | 0361307 | 4/1990 |
| EP | 0382963 | 8/1990 |
| EP | 1079187 | 2/2001 |
| EP | 1 174 666 | 1/2002 |
| GB | 850555 | 10/1960 |
| JP | 54-68557 | 6/1979 |
| KR | 1999-019291 | 3/1999 |
| KR | 10-0288258 | 2/2001 |
| WO | WO 93/08434 | 4/1993 |

OTHER PUBLICATIONS

U.S. Appl. No. 10/385,566, filed Mar. 12, 2003, Jae-Seung Lee, Samsung Electronics Co. Ltd.

U.S. Appl. No. 10/644,937, filed Aug. 21, 2003, Lee et al., Samsung Electronics Co. Ltd.

U.S. Appl. No. 10/644,961, filed Aug. 21, 2003, Lee et al., Samsung Electronics Co. Ltd.

European Search Report dated Jun. 11, 2004 issued in European Application No. 03255169.9-2301.

European Search Report dated May 11, 2004 issued in European Application No. 03025146.6-2301.

* cited by examiner

REFRIGERATOR

CROSS-REFERENCE TO RELATED APPLICATIONS

This application claims the benefit of Korean Application No. 2003-3373, filed Jan. 17, 2003 and Korean Application No. 2003-19482, filed Mar. 28, 2003 in the Korean Intellectual Property Office, the disclosures of which are incorporated herein by reference.

BACKGROUND OF THE INVENTION

1. Field of the Invention

The present invention relates generally to refrigerators, and, more particularly, to a refrigerator that is provided in an upper portion thereof with a cooling room and a machine room.

2. Description of the Related Art

In general, a refrigerator is an apparatus that maintains the freshness of various foods for a lengthy period of time by feeding cold air generated in an evaporator to a storage chamber. Recently, as users who are fond of a large-sized storage chamber increase, there is a trend toward large-sized refrigerators. These refrigerators may be exemplified by side-by-side refrigerators in which a storage chamber is divided by a partition wall into a freezer compartment and a refrigerator compartment on the right and left sides of the refrigerator.

A side-by-side refrigerator has a storage chamber that is divided into a freezer compartment and a refrigerator compartment. A freezer compartment door and a refrigerator compartment door are attached to front sides of the freezer compartment and the refrigerator compartment to selectively open and close them, respectively. A plurality of shelves and containers are provided in the freezer compartment, the refrigerator compartment, and the doors. An evaporator and a cold air circulating fan, that generate and supply cold air, and a cold air duct, that forms a cold air passage, are positioned in a rear portion of each of the freezer and refrigerator compartments. A plurality of cold air outlets and air inlets are formed in a front side of the cold air duct. Further, a machine room partitioned from the freezer and refrigerator compartments is formed in a rear lower portion of a refrigerator body to accommodate a condenser, a compressor, a cooling fan, etc.

However, in the conventional side-by-side refrigerator, the evaporator that generates cold air, and the air circulating fan that circulates the cold air, are not only disposed in a rear portion of each of the freezer and refrigerator compartments, but the machine room that contains the compressor and the condenser is also positioned in a rear lower portion of the body, so available inner spaces of the freezer and refrigerator compartments are reduced.

In particular, large sized refrigerators, such as the conventional side-by-side refrigerator, have a relatively great height, so a small user easily uses a lower space of the storage chamber, compared with an upper space of the storage chamber. Meanwhile, in the conventional side-by-side refrigerator, the machine room is arranged in a rear lower portion of the body, and occupies a lower space of the storage chamber, so the lower space of the storage chamber that is conveniently used is reduced.

Further, in the conventional refrigerator, mounting structures through which the evaporator, the cold air circulating fan, and passage parts are disposed in a rear portion of each of the freezer and refrigerator compartments are complicated, so the mounting efficiency of these parts is low, thus deteriorating the manufacturing efficiency of the refrigerator.

SUMMARY OF THE INVENTION

Accordingly, it is an aspect of the present invention to provide a refrigerator which is provided with a cooling room and a machine room at altered positions, thus maximizing an available space of a storage chamber thereof.

It is another aspect of the present invention to provide a refrigerator which allows inside parts thereof to be easily attached thereto, thereby facilitating manufacture thereof, and therefore improving the manufacturing efficiency thereof.

Additional aspects and/or advantages of the invention will be set forth in part in the description which follows and, in part, will be obvious from the description, or may be learned by practice of the invention.

The foregoing and/or other aspects of the present invention are achieved by providing a refrigerator, including a body provided therein with a storage chamber, an uplifted part projected from a rear portion of a top of the body so that a cooling room is formed to have a space extending above the storage chamber, a machine room provided above a front portion of the top of the body and in front of the uplifted part, a cooling unit removably disposed in the cooling room, an evaporator and a cold air circulating fan provided in a cold air passage of the cooling unit, and circulating passages formed in upper and rear portions of the storage chamber, respectively, to be connected to the cold air passage of the cooling unit.

The cooling unit may include a unit casing containing the evaporator, an inlet formed in a front lower portion of the unit casing to be connected to the circulating passage formed in an upper portion of the storage chamber, an exit formed in an rear upper portion of the unit casing, and a discharge passage vertically formed in a rear side of the unit casing to connect the exit and the circulating passage formed in the rear portion of the storage chamber, and the cold air circulating fan may be disposed in an upper portion of an interior of the unit casing.

The refrigerator may further include a metallic heat conducting plate attached to an inside surface of the unit casing around the evaporator.

The unit casing may be made of insulating material, or be made by forming resin material and attaching insulating material to a surface of the formed resin material.

The cooling unit may further include a water tray disposed under the evaporator in the unit casing, and a drain hole formed in a lower portion of the unit casing to drain water collected in the water tray.

The cooling unit may further include a fan casing attached to an upper portion of the unit casing to surround the cold air circulating fan and to support the cold air circulating fan to be rotated.

The cold air circulating fan may be a cross flow fan disposed above the evaporator along a length of the evaporator.

The cold air circulating fan may be a centrifugal fan that blows air in the unit casing toward the discharge passage.

The cold air circulating fan may be an axial flow fan that blows air in the unit casing toward the discharge passage.

The cooling unit may include a unit casing containing the evaporator, a plurality of inlets formed in front lower portions of the unit casing to be connected to the circulating passage formed in the upper portion of the storage chamber, an exit formed in a front upper portion of the unit casing, and a discharge passage vertically formed in the front side of the unit casing to connect the exit and the circulating passage formed in a rear portion of the storage chamber, and the cold air circulating fan may be disposed in an upper portion of an interior of the unit casing and near the exit.

The refrigerator may further include an upper passage member spaced apart from a top of the storage chamber to form the circulating passage in the upper portion of the storage chamber, and a rear passage member spaced apart from the rear side of the storage chamber to form the circulating passage in the rear portion of the storage chamber.

The refrigerator may further include a cooling room casing disposed inside the uplifted part to define the cooling room, the cooling room casing provided on an outer surface thereof with a plurality of reinforcing ribs to prevent deformation of the cooling room casing while insulating material fills a space between the cooling room casing and an outer casing of the body during manufacture of the body.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
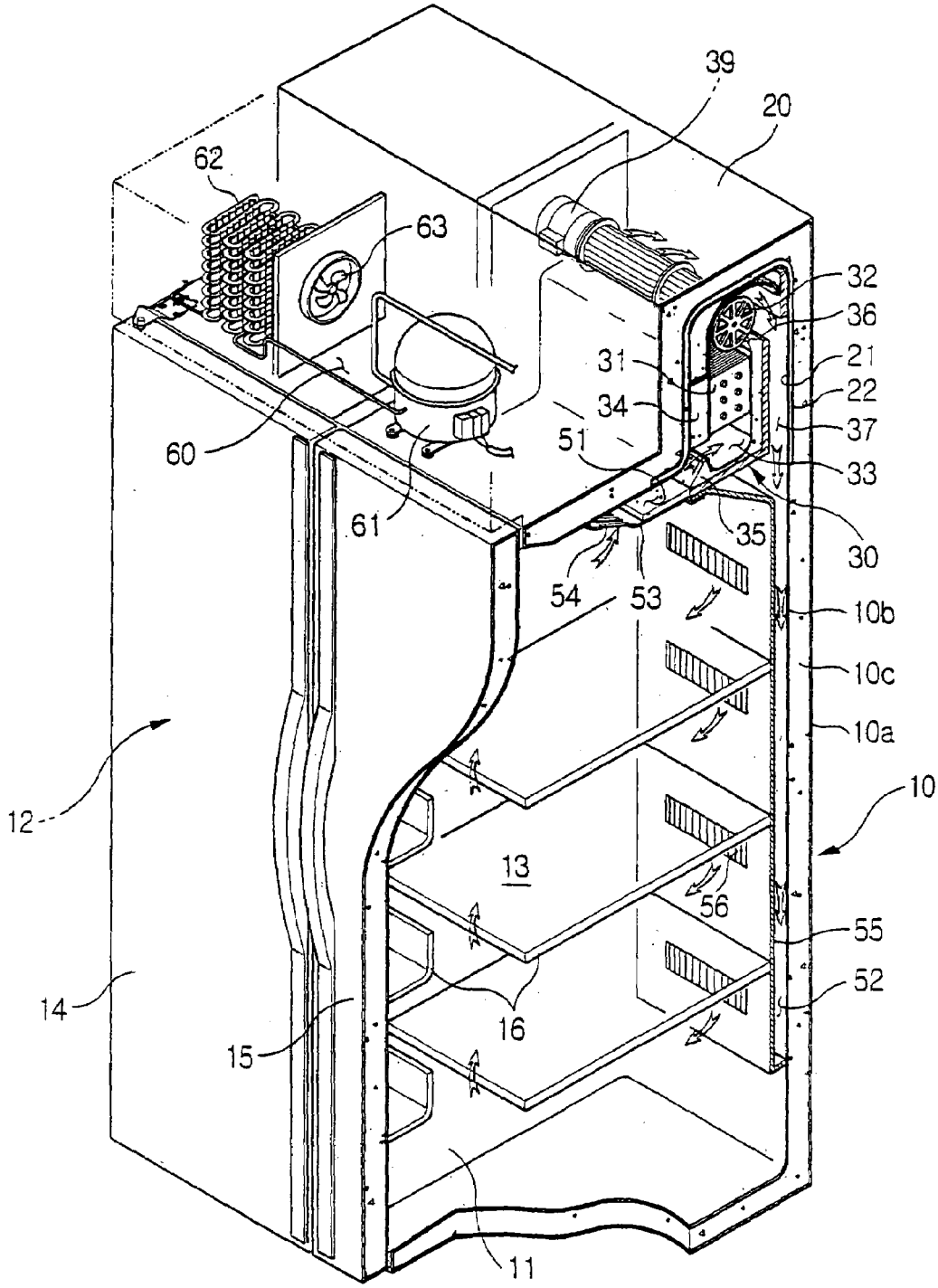
FIG. 1 is a perspective view showing a refrigerator, according to an embodiment of the present invention.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures. An embodiment of the present invention is illustrated in FIGS. 1 to 8, and another embodiment of the present invention is illustrated in FIGS. 9 to 12.

Figure 2:
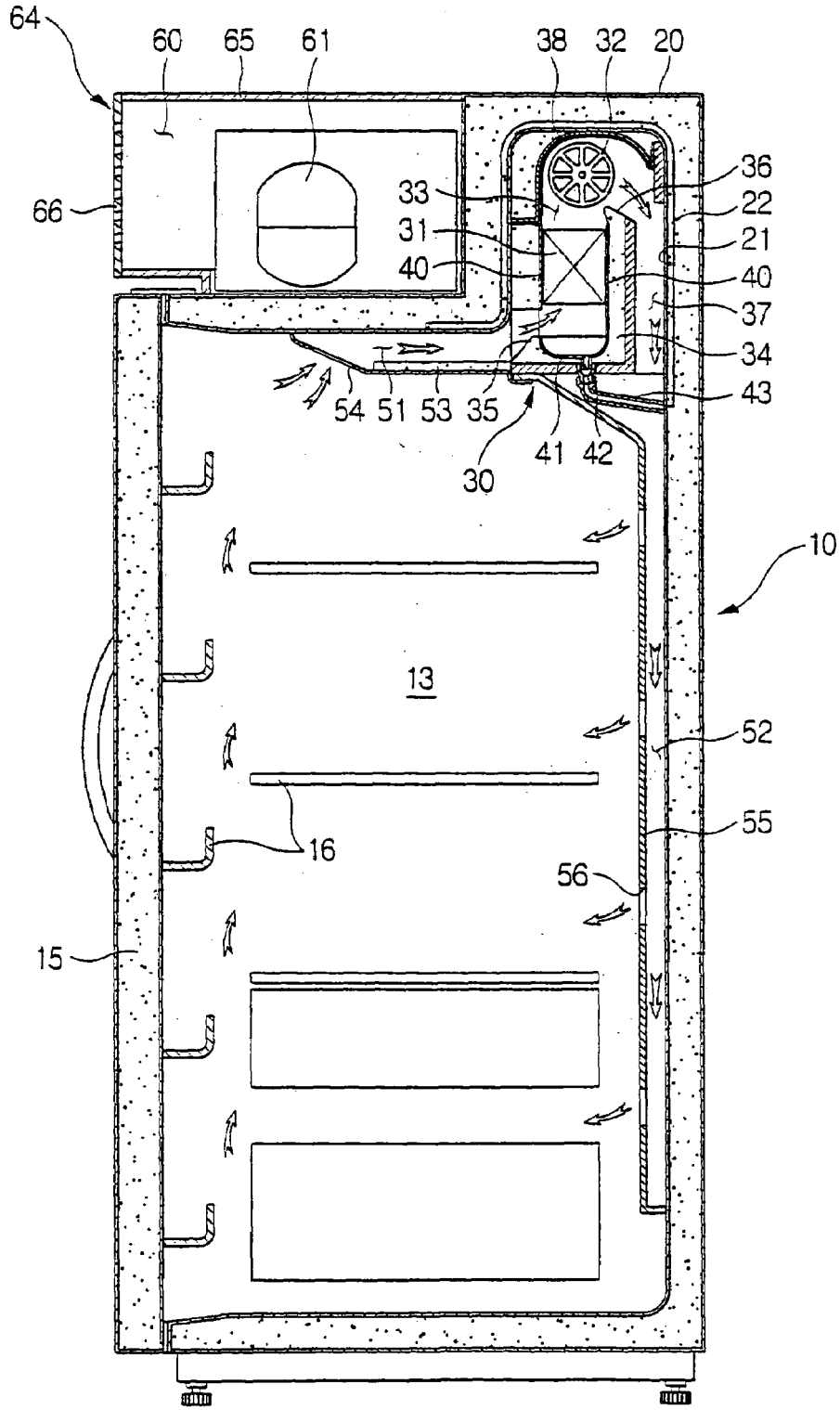
FIG. 2 is a sectional view of the refrigerator of FIG. 1.
Figure 3:
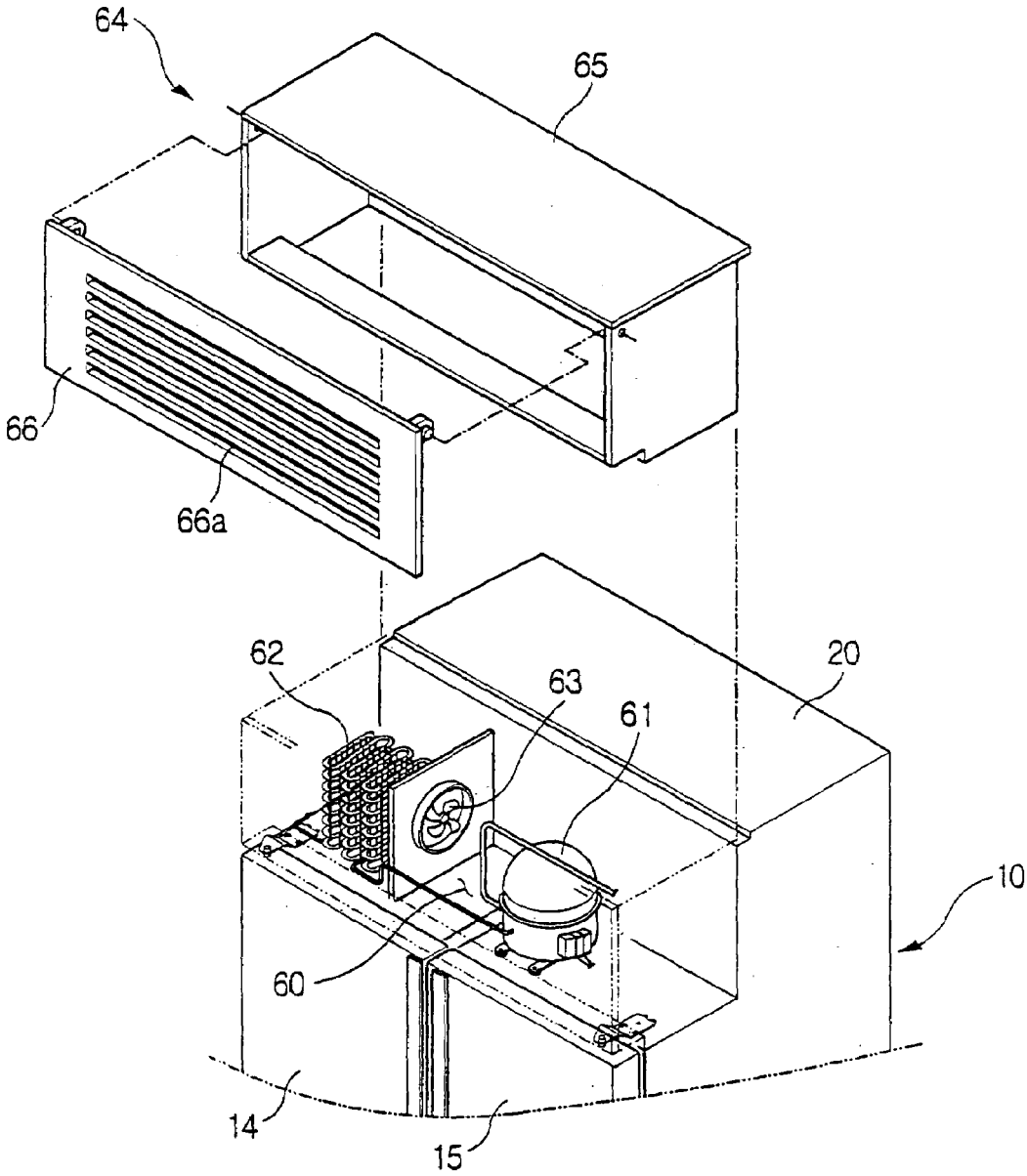
FIG. 3 is a partially exploded perspective view showing a machine room of the refrigerator of FIG. 1.

A refrigerator according to an embodiment of the present invention, as shown in FIGS. 1 and 2, is constructed to allow a storage chamber formed in a body 10 to be divided by a partition wall 11 into a freezer compartment 12 and a refrigerator compartment 13 on the left and right sides of the refrigerator, respectively. A freezer compartment door 14 and a refrigerator compartment door 15 are attached to the front sides of the freezer compartment 12 and the refrigerator compartment 13 to selectively open and close them, respectively. A plurality of shelves 16 are provided in the freezer compartment 12, the refrigerator compartment 13, and the doors 14 and 15.

An uplifted part 20 protruding upward from the body 10 is provided in a rear upper portion of the body 10 to form a cooling room 21 that accommodates an evaporator 31 and a cool air circulating fan 32. The uplifted part 20 is formed by extending a space upward from tops of rear portions of the freezer compartment 12 and the refrigerator compartment 13, and allows the cooling room 21 to be transversely formed above the rear portions of the freezer compartment 12 and the refrigerator compartment 13, respectively.

A machine room 60 is formed in front of the uplifted part 20 and above the body 10 to accommodate a compressor 61, a condenser 62 and a cooling fan 63. The position of the machine room 60 is designed to enlarge the inner spaces of the freezer compartment 12 and the refrigerator compartment 13 by removing the machine room from the rear lower portion of the body 10, that is, the position of the conventional machine room, to a position above the rear side of the top of the body 10, that is, the position of the machine room of the present invention. The machine room 60 is defined by a machine room casing 64. The machine room casing 64 includes a box-shaped cover member 65 attached to the body 10 and a door member 66 designed to selectively open and close a front side of the cover member 65. The door member 66 is attached at both sides thereof to the cover member 65 to be rotated, and is provided therethrough with a plurality of vent slits 66*a* to circulate air.

Figure 4:
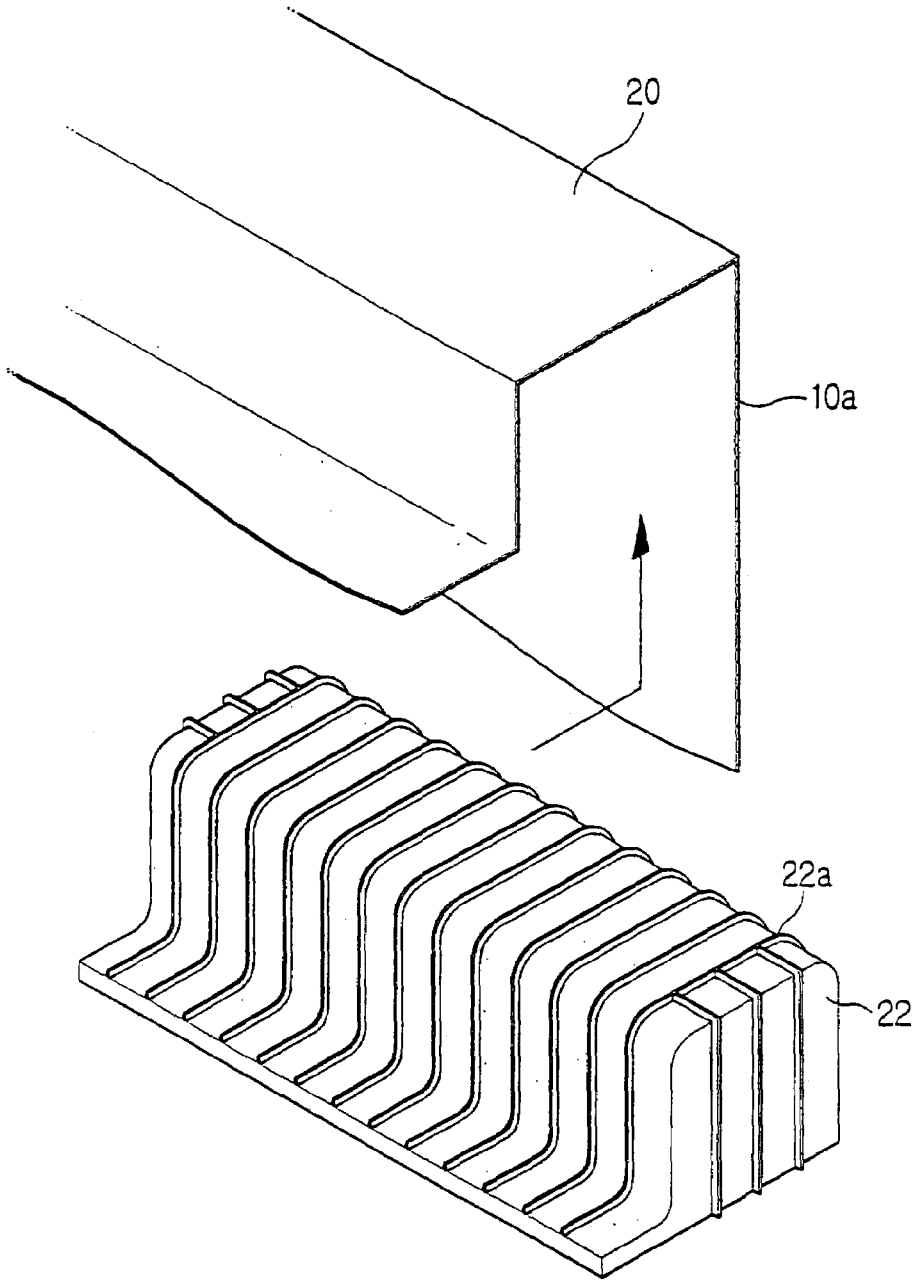
FIG. 4 is a perspective view showing a cooling room casing of the refrigerator of FIG. 1.
Figure 5:
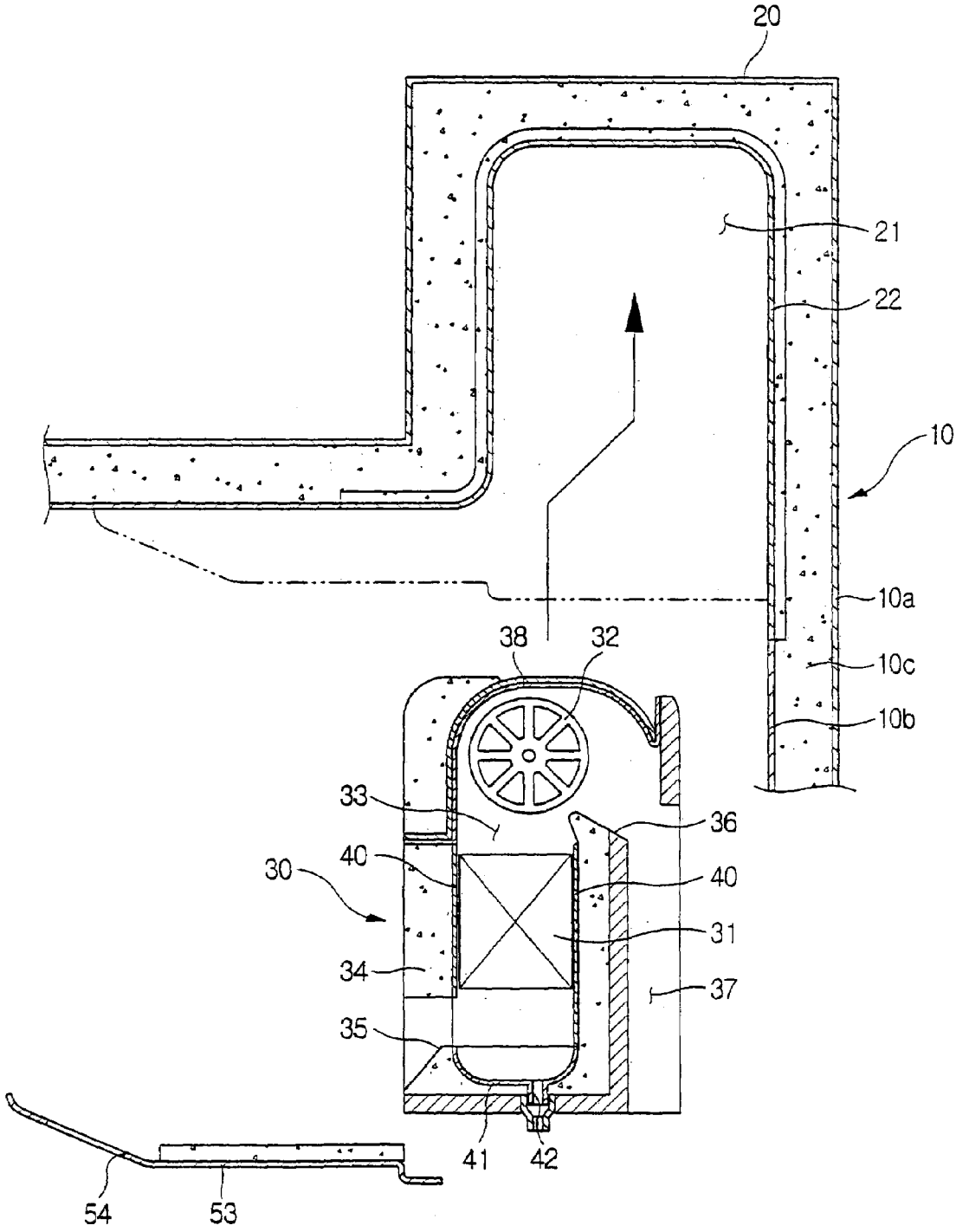
FIG. 5 is a sectional view showing a cooling unit and the cooling room of the refrigerator of FIG. 1.

The body 10 of the present invention, as shown in FIGS. 4 and 5, is formed of an insulating wall that is formed by filling a space between an outer casing 10*a* and an inner casing 10*b* with a foam insulating material 10*c*. A cooling room casing 22 is positioned inside the outer casing 10*a* in the uplifted part 20, instead of inside the inner casing 10*b*. The uplifted part 20 is formed to facilitate formation of the cooling room 21 in such a way that the foam insulating material 10*c* fills a space between the cooling room casing 22 and the outer casing 10*a* of the body 10 after the cooling room casing 22, fabricated in the form of the cooling room 21, is disposed. A plurality of reinforcing ribs 22*a* are formed on an outside of the cooling room casing 22 to prevent deformation of the cooling room casing 22 while the insulating material 10*c* is filled into the space during manufacture of the body 10.

A box-shaped cooling unit 30 in which the evaporator 31, a cold air circulating fan 32, and a cold air passage 33 are integrated into a single body is positioned in the cooling room 21, inside the uplifted part 20, to generate and circulate cold air. Circulating passages 51 and 52 are formed in the upper and rear portions of the refrigerating compartment 13, respectively, to be connected to the cold air passage 33 formed in the cooling unit 30. As shown in FIG. 5, with this construction, a refrigerator may be easily manufactured by assembling a part for forming the cold air passage 33 inside the cooling room 21, the evaporator 31, and the cold air circulating fan 32 into a single assembly and inserting the single assembly into the cooling room 21.

Figure 6:
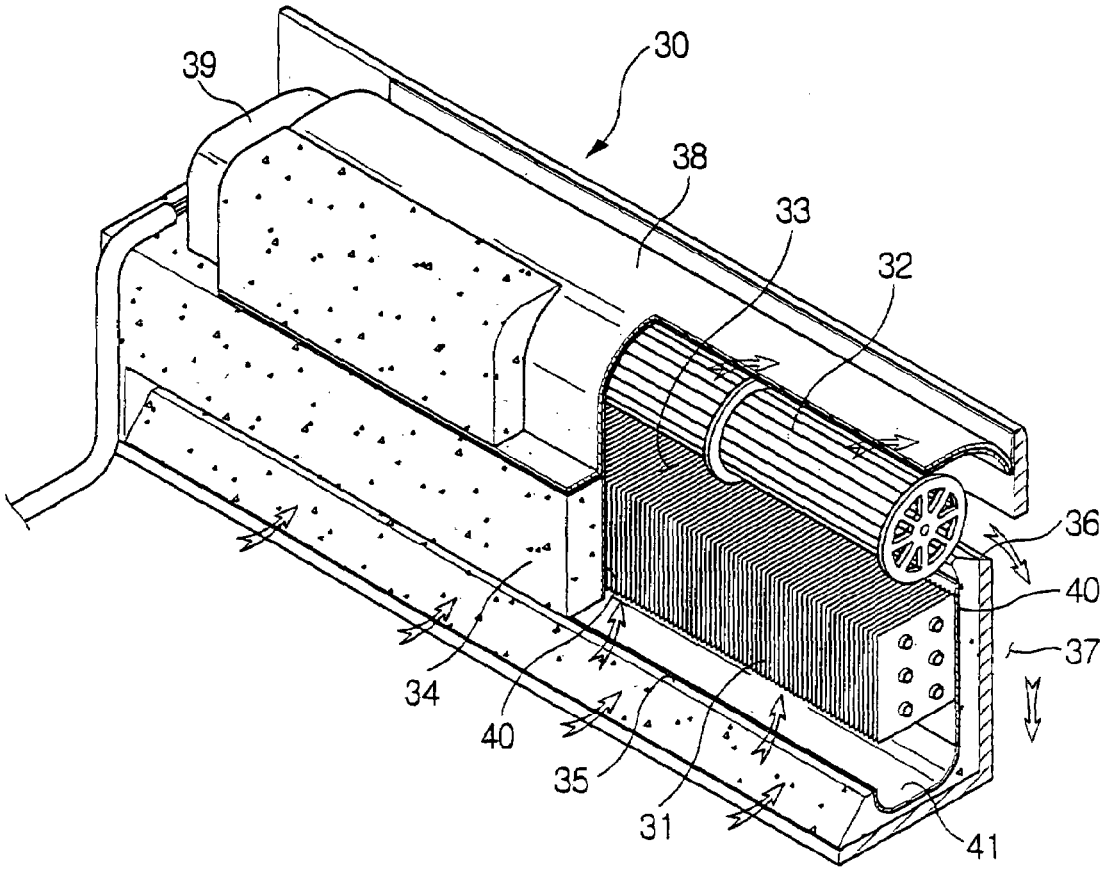
FIG. 6 is a partially cutaway perspective view of the cooling unit of the refrigerator of FIG. 1.

The cooling unit 30 includes a hexahedral unit casing 34 that is provided therein with the cooling air passage 33, as shown in FIGS. 2, 5 and 6. The evaporator 31 and the cold air circulating fan 32 are formed in the cold air passage 33 formed in the unit casing 34. An inlet 35 is horizontally formed in a front lower portion of the unit casing 34 to be connected to the circulating passage 51 formed in the upper portion of the refrigerator compartment 13, an exit 36 is horizontally formed in a rear upper portion of the unit casing 34, and a discharge passage 37 is vertically formed in the rear side of the unit casing 34 to connect the exit 36 and the circulating passage 52 formed in the rear portion of the refrigerator compartment 13.

The cold air circulating fan 32 that blows air, having passed through the evaporator 31, toward the discharge passage 37 formed in the rear side of the unit casing 34, is positioned over the evaporator 31 and near the exit 36 of the unit casing 34, and is formed of a cross flow fan that extends along a length of the evaporator 31. A fan casing 38 is formed to surround the cold air circulating fan 32 and to support the cold air circulating fan 32 to be rotated. A motor 39 is positioned outside the fan casing 38 to drive the cold air circulating fan 32.

The unit casing 34 is formed of a plurality of insulating materials, including Styrofoam, or is manufactured by forming resin material and attaching insulating material to the formed resin material so as to insulate the cold air passage 33 inside the unit casing 34 from the refrigerator compartment 13. This construction of the unit casing 34 is designed to prevent dew from condensing on an outer surface of the unit casing 34 due to a difference between the temperatures inside and outside of the cooling unit 30.

A metallic heat conducting plate 40, having a thin plate shape, is positioned on an inner surface of the unit casing 34 around the evaporator 31 of the cooling unit 30. The heat conducting plate 40 is attached to the inner surface of the unit casing 34 to surround the evaporator 31 and come in contact with the evaporator 31. The construction of the heat conducting plate 40 is designed so that a heat exchange occurs between air and the heat conducting plate 40 by effectively transferring cold from the evaporator 31 to the conducting plate 40 during a cooling operation, and a defrosting performance is improved by effectively transferring heat from a heater (not shown) provided in the evaporator 31 to an interior of the cooling unit 30 through the heat conducting plate 40. A water tray 41 is disposed on the inner surface of the unit casing 34, under the evaporator 31, to collect water during the defrosting operation of the evaporator 31. A drain hole 42 is formed in a bottom of the unit casing 34, to be connected to a water discharge passage 43, so as to discharge the water collected in the water tray 41.

The circulating passages 51 and 52, connected to the cold air passage 33 of the cooling unit 30, and provided in the upper and rear portions of the refrigerator compartment 13, as depicted in FIG. 2, are defined by an upper passage member 53 spaced apart from a top of the refrigerator compartment 13 and provided with an inlet 54, and a rear passage member 55 spaced apart from a rear side of the refrigerator compartment 13 and provided with a plurality of outlets 56. In this case, the upper circulating passage 51, defined by the upper passage member 53, directs air in the refrigerator compartment 13 into the cooling unit 30, and the rear circulating passage 52, defined by the rear passage member 55, directs cold air in the cooling unit 30 into the refrigerator compartment 13. Although structures of air passages and a cooling room 21 for the freezer compartment 12 are shown in the accompanying drawings, these are similar to those for the refrigerator compartment, so a description thereof is omitted.

Figure 7:
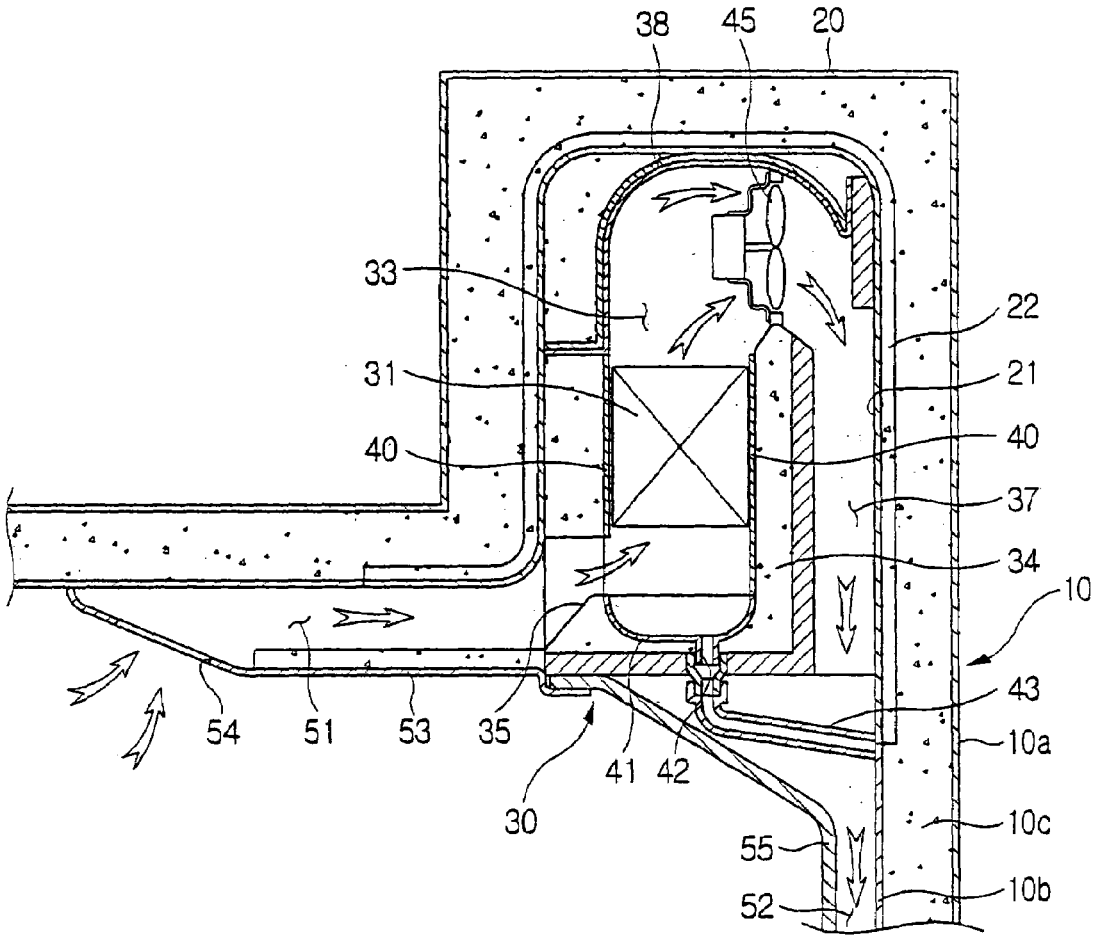
FIG. 7 is a view showing an example in which a cold air circulating fan is formed of an axial flow fan in the cooling unit of FIG. 6.
Figure 8:
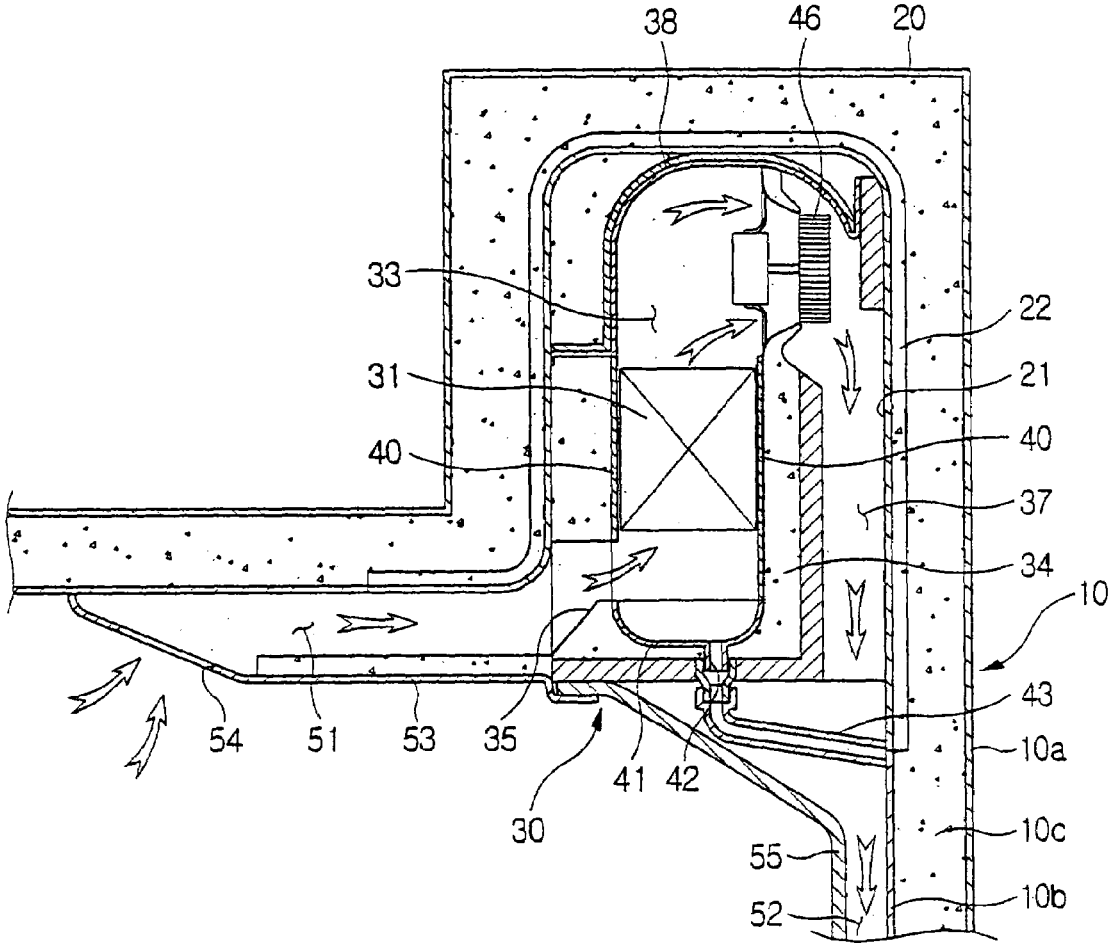
FIG. 8 is a view showing an example in which a cold air circulating fan is formed of a multi-blade centrifugal fan in the cooling unit of FIG. 6.

FIG. 7 is a view showing an example in which a cold air circulating fan 45 is formed of an axial flow fan in the cooling unit 30 of the first embodiment. FIG. 8 is a view showing another example in which a cold air circulating fan 46 is formed of a multi-blade centrifugal fan. The other constructions and operations thereof are the same as those described above.

In a cold air circulating operation of the refrigerator, air in the refrigerator compartment 13 is drawn toward the evaporator 31 of the cooling unit 30 through the circulating passage 51 in the upper portion of the refrigerator compartment 13 by the operation of the cold air circulating fan 32, 45 or 46. The air becomes cold while passing through the evaporator 31, is fed into the rear circulating passage 52 in the rear portion of the refrigerator compartment 13 by the operation of the cold air circulating fan 32, 45 or 46, and is dispersedly discharged to the refrigerator compartment 13 through the plurality of outlets 56, thus effectively circulating cold air. Air circulation throughout the freezer compartment 12 is performed in the same manner. Although this embodiment has adopted the way in which air inside the refrigerator compartment 13 is drawn through the upper circulating passage 51, passes through the cooling unit 30 and is returned to the refrigerator compartment 13 through the rear circulating passage 52, a reverse air circulation may be performed if the construction of the inner passage of the cooling unit 30 is somewhat changed. That is, air in the refrigerator compartment 13 may be drawn through the rear circulating passage 52, and be fed into the refrigerator compartment 13 through the upper circulating passage 51.

Figure 9:
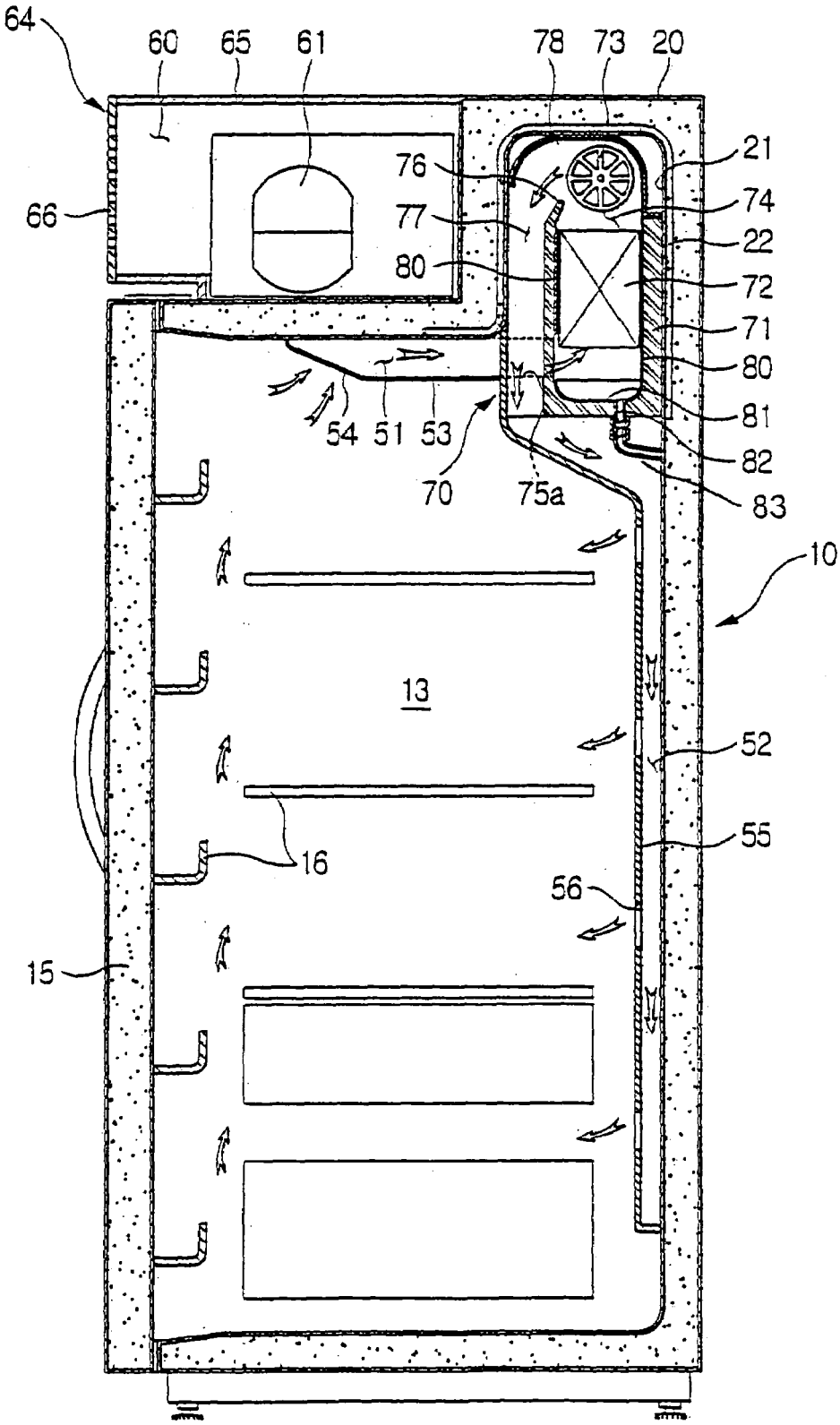
FIG. 9 is a perspective view showing a refrigerator, according to another embodiment of the present invention.

A refrigerator according to another embodiment of the present invention is illustrated in FIG. 9. This embodiment is constructed in such a way that a cooling unit equipped with a relatively large capacity evaporator is disposed in a refrigerator body identical with that of the refrigerator of the previous embodiment. In the following description, the same names and the same reference numerals are assigned to the same elements.

Figure 10:
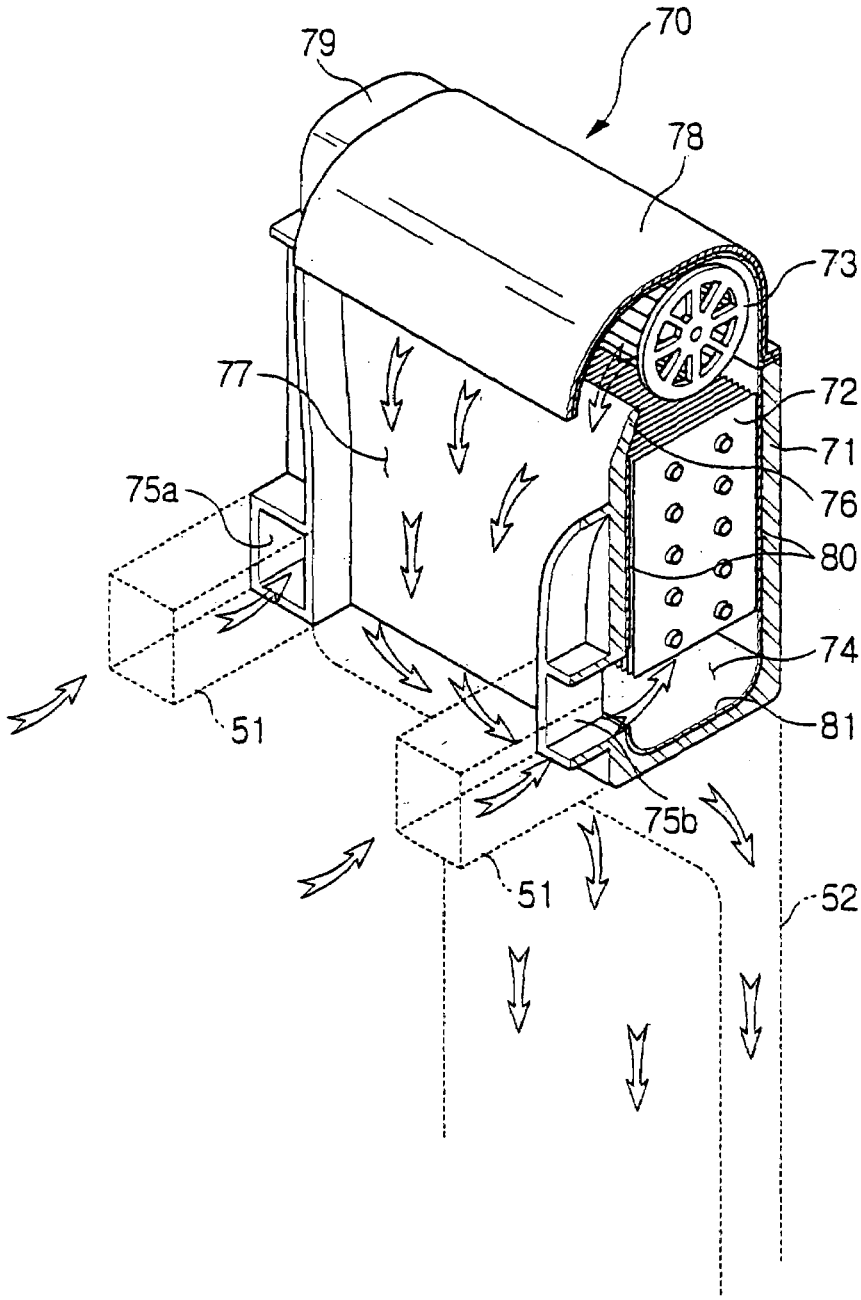
FIG. 10 is a partially cutaway perspective view of the cooling unit of the refrigerator of FIG. 9.

The cooling unit 70, as shown in FIGS. 9 and 10, includes a box-shaped unit casing 71 formed of insulating materials, or formed by attaching an insulating material to a resin material. An evaporator 72 and a cold air circulating fan 73 are disposed in a cold air passage 74 formed in the unit casing 71.

Two inlets 75*a* and 75*b* are formed in two lower portions of an inner side of the unit casing 71 to be connected to a circulating passage 51 formed in an upper portion of a refrigerator compartment 13, an exit 76 is horizontally formed in an upper portion of the inner side of the unit casing 71, and a discharge passage 77 is vertically formed in the inner side of the unit casing 34 to connect the exit 76 and a circulating passage 52 formed in a rear portion of the refrigerator compartment 13. In this case, the discharge passage 77 and the two inlets 75*a* and 75*b* are separated from each other to prevent air flowing into the unit casing 71 and air flowing out of the unit casing 71 from being mixed.

The cold air circulating fan 73 of this embodiment, which blows air having passed through the evaporator 72 toward the exit 76 formed in the upper portion of the inner side of the unit casing 71, is positioned over the evaporator 72 and near the exit 76 of the unit casing 71, and is formed of a cross flow fan that extends along a length of the evaporator 72. In this case, a fan casing 78 is formed to surround the cold air circulating fan 73, and to support the cold air circulating fan 73 to be rotated. A motor 79 is positioned outside the fan casing 78 to drive the cold air circulating fan 73. A metallic heat conducting plate 80, having a thin plate shape, is positioned on an inner surface of the unit casing 71 around the evaporator 72 in the same manner as that of the previous embodiment. A water tray 81 is disposed on an inner surface of the unit casing 71, under the evaporator 72, to collect water during the defrosting operation of the evaporator 72. A drain hole 82 is formed in a bottom of the unit casing 71 to be connected to a water discharge passage 83 so as to discharge water collected in the water tray 81.

Figure 11:
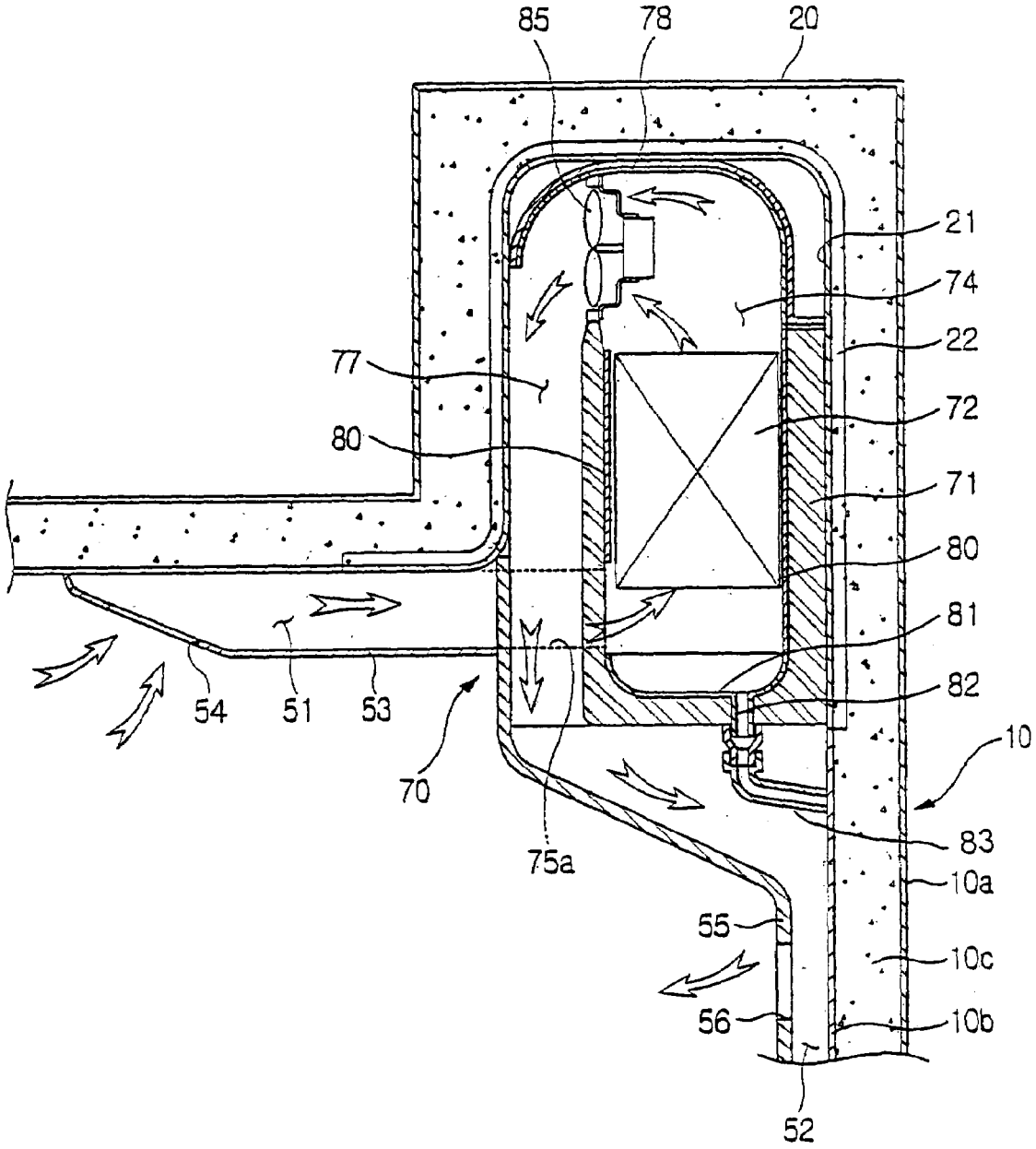
FIG. 11 is a view showing an example in which a cold air circulating fan is formed of an axial flow fan in the cooling unit of FIG. 9.
Figure 12:
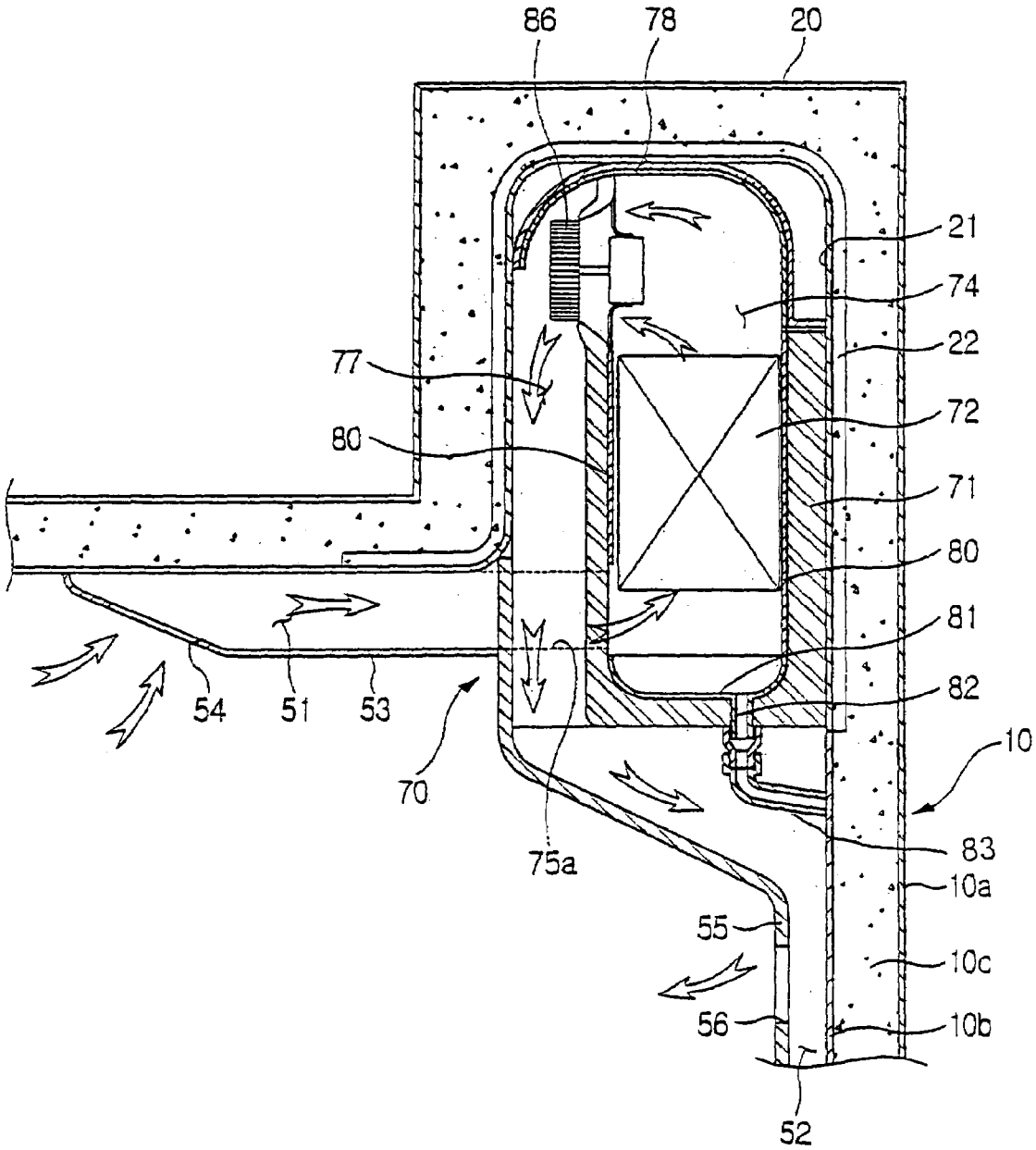
FIG. 12 is a view showing an example in which a cold air circulating fan is formed of a multi-blade centrifugal fan in the cooling unit of FIG. 9.

FIG. 11 is a view showing an example in which a cold air circulating fan 85 is formed of an axial flow fan in the cooling unit 70 of this embodiment. FIG. 12 is a view showing another example in which a cold air circulating fan 86 is formed of a multi-blade centrifugal fan. The circulation of cold air is the same as that in the previous embodiment, and a detailed description thereof is omitted.

As is apparent from the above description, the present invention provides a refrigerator in which a cooling room is provided in a rear upper portion of a body, and a machine room is provided in a front upper portion of the refrigerator, so an inner space of a lower portion of a storage chamber, which may be easily utilized, is maximized.

In the refrigerator of the present invention, the evaporator, the cold air circulating fan, and the passage parts are integrated into the cooling unit, so inner parts for the cooling room may be easily disposed in the cooling room, thus facilitating the manufacture of the refrigerator and, consequently, improving the manufacturing efficiency.

In addition, cold air in the refrigerator is dispersedly discharged to the storage chamber through a plurality of outlets formed in the rear portion of the storage chamber, so the circulating efficiency of cold air is improved and, accordingly, the cooling efficiency of the refrigerator is improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a body provided therein with a storage chamber;

an uplifted part projected from a rear portion of a top of the body so that a cooling room is formed to have a space extending above the storage chamber;

a machine room provided above a front portion of the top of the body and in front of the uplifted part;

a cooling unit removably disposed in the cooling room;

an evaporator and a cold air circulating fan provided in a cold air passage of the cooling unit; and circulating passages formed in upper and rear portions of the storage chamber, respectively, to be connected to the cold air passage of the cooling unit, wherein the cooling unit comprises:

a unit casing containing the evaporator;

an inlet formed in a front lower portion of the unit casing to be connected to the circulating passage formed in an upper portion of the storage chamber;

an exit formed in an rear upper portion of the unit casing; and a discharge passage vertically formed in a rear side of the unit casing to connect the exit and the circulating passage formed in the rear portion of the storage chamber;

wherein the cold air circulating fan is disposed in an upper portion of an interior of the unit casing.

2. The refrigerator as set forth in claim 1, further comprising a metallic heat conducting plate attached to an inside surface of the unit casing around the evaporator.

3. The refrigerator as set forth in claim 1, wherein the unit casing is made of insulating material.

4. The refrigerator as set forth in claim 3, wherein the insulating material comprises Styrofoam®.

5. The refrigerator as set forth in claim 1, wherein the unit casing is made by forming resin material and attaching insulating material to a surface of the formed resin material.

6. The refrigerator as set forth in claim 1, wherein the cooling unit further comprises:

a water tray disposed under the evaporator in the unit casing; and a drain hole formed in a lower portion of the unit casing to drain water collected in the water tray.

7. The refrigerator as set forth in claim 1, wherein the cooling unit further comprises a fan casing attached to an upper portion of the unit casing to surround the cold air circulating fan and to support the cold air circulating fan to be rotated.

8. The refrigerator as set forth in claim 7, further comprising a motor provided outside the fan casing to drive the cold air circulating fan.

9. The refrigerator as set forth in claim 7, wherein the cold air circulating fan is a cross flow fan disposed above the evaporator along a length of the evaporator.

10. The refrigerator as set forth in claim 1, wherein the cold air circulating fan is a centrifugal fan that blows air in the unit casing toward the discharge passage.

11. The refrigerator as set forth in claim 1, wherein the cold air circulating fan is an axial flow fan that blows air in the unit casing toward the discharge passage.

12. The refrigerator as set forth in claim 1, further comprising:

an upper passage member spaced apart from a top of the storage chamber to form the circulating passage in the upper portion of the storage chamber; and a rear passage member spaced apart from the rear side of the storage chamber to form the circulating passage in the rear portion of the storage chamber.

13. The refrigerator as set forth in claim 1, further comprising a cooling room casing disposed inside the uplifted part to define the cooling room, wherein the cooling room casing is provided on an outer surface thereof with a plurality of reinforcing ribs.

14. The refrigerator as set forth in claim 13, wherein the body of the refrigerator comprises:

an outer casing;

an inner casing; and an insulating wall formed by filling a space between the outer and inner casing with an insulating material;

wherein the cooling room casing is provided inside the outer casing in the uplifted part, and outside the inner casing, and the reinforcing ribs prevent deformation of the cooling room casing from the filling of the insulating material.

15. The refrigerator as set forth in claim 1, further comprising:

a compressor;

a condenser; and a cooling fan;

wherein the compressor, condenser, and cooling fan are provided in the machine room.

16. The refrigerator as set forth in claim 1, further comprising a machine room casing, wherein the machine room is defined by the machine room casing.

17. The refrigerator as set forth in claim 16, wherein the machine room casing comprises:

a box-shaped cover member attached to the body of the refrigerator; and a door member selectively opening and closing a front side of the cover member.

18. The refrigerator as set forth in claim 17, wherein the door member is attached at both sides thereof to the cover member to be rotated.

19. The refrigerator as set forth in claim 17, wherein the door member is provided with a plurality of vent slits to circulate air.

20. The refrigerator as set forth in claim 1, wherein the cooling unit is a single integrated body comprising the evaporator, the cold air circulating fan, and the cold air passage.

21. The refrigerator as set forth in claim 1, further comprising a plurality of outlets formed in the rear portion of the storage chamber, wherein the outlets provide increased circulation of cold air.

* * * * *